US005123558A

United States Patent [19]

Moloney

[11] Patent Number: 5,123,558

[45] Date of Patent: Jun. 23, 1992

[54] CAN CAP AND COASTER

[76] Inventor: John G. Moloney, P.O. Box 801682, Houston, Tex. 77280-1682

[21] Appl. No.: 685,114

[22] Filed: Apr. 15, 1991

Related U.S. Application Data

[63] Continuation-in-part of Ser. No. 615,392, Nov. 19, 1990, abandoned, which is a continuation-in-part of Ser. No. 526,648, May 5, 1990, abandoned.

[51] Int. Cl.[5] ..... B65D 51/24

[52] U.S. Cl. ..... 220/212; 220/258; 220/306; 220/737; 220/740; 248/346.1

[58] Field of Search ..... 220/212, 258, 306, 90.4, 220/85 H, 903, 737, 740; 215/100.5, 228; 248/346.1

[56] References Cited

U.S. PATENT DOCUMENTS

| | | | |
|---|---|---|---|
| 1,957,263 | 5/1934 | Gray | 215/100.5 |
| 2,617,549 | 11/1952 | Egger | 215/100 R |
| 2,731,056 | 1/1956 | Anson | 215/100.5 X |
| 2,766,796 | 10/1956 | Tupper | 220/521 |
| 2,929,526 | 3/1960 | Steinberg | 215/100.5 |
| 3,173,574 | 3/1965 | Goldsmith | 206/508 |
| 3,350,131 | 10/1967 | Tarzer | 215/100.5 X |
| 3,378,680 | 4/1968 | Moxley | 215/100.5 X |
| 3,606,074 | 9/1971 | Hayes | 220/212 |
| 3,633,863 | 1/1972 | Abbey | 248/346.1 |
| 3,809,353 | 5/1974 | Good et al. | 248/346.1 |
| 4,040,535 | 8/1977 | Shepard | 215/100.5 |
| 4,917,258 | 4/1990 | Boyd et al. | 220/240 |
| 4,984,723 | 1/1991 | Hsu | 220/737 X |

*Primary Examiner*—Stephen Marcus
*Assistant Examiner*—Stephen Cronin
*Attorney, Agent, or Firm*—Fulbright & Jaworski

[57] ABSTRACT

A combination cap closure includes a member having a support surface surrounded by a rim to form a coaster for receiving a can and to sealingly engage a lip on a can. The rim includes a plurality of grooves which allows the accumulation of moisture from the can into the coaster, but restricts fluid flow from the coaster.

8 Claims, 1 Drawing Sheet

FIG.1
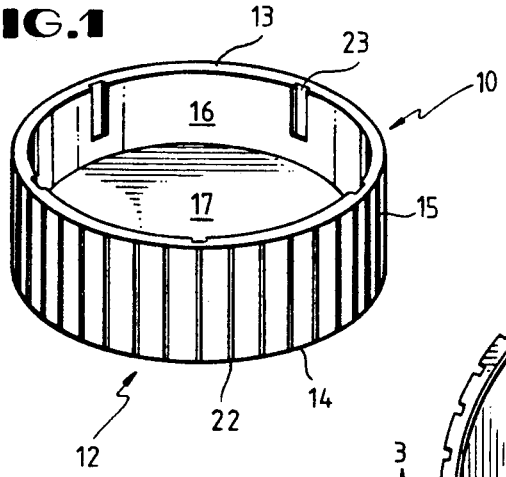
FIG.2
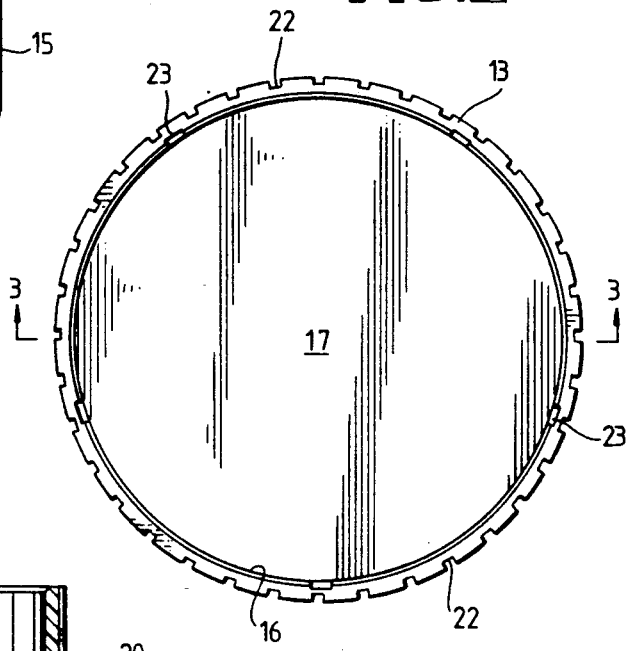
FIG.3
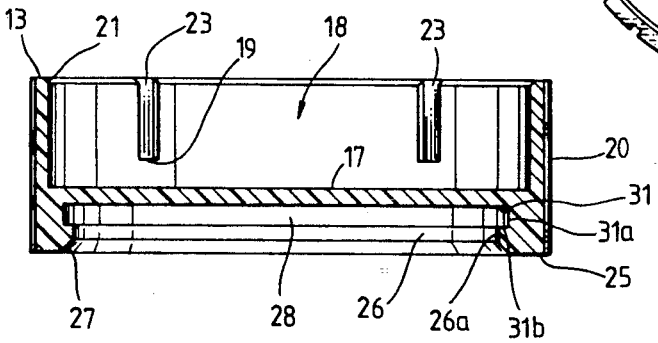
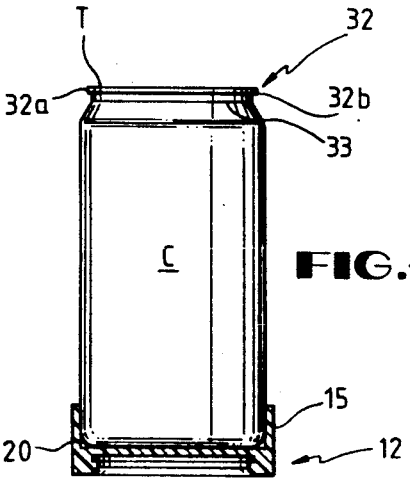
FIG.4
FIG.5
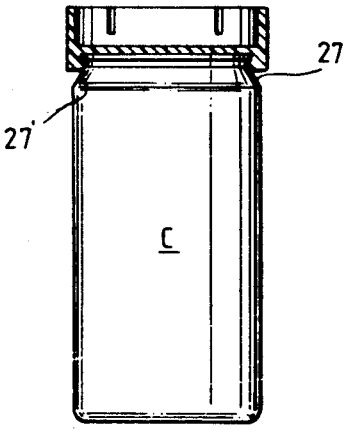

CAN CAP AND COASTER

CROSS-REFERENCE TO RELATED APPLICATIONS

This application is a continuation-in-part of my prior copending patent application Ser. No. 07/615,392, filed Nov. 19, 1990 now abandoned, for Can Cap and Coaster which was a continuation-in-part of my prior copending application Ser. No. 07/526,648, filed May 5, 1990, now abandoned.

BACKGROUND OF THE INVENTION

Various patents have issued relating to structures which serve as a combination coaster to support a drink can, as well as serving as a closure for engaging with the drink can for closing off the top of the can to preserve the contents thereof. In addition, some of the prior art devices provide a coaster to receive condensation formed on the outside of the can and prevent such condensation from dripping or flowing onto the table or other support on which the coaster with the can therein may be placed.

However, even though the condensation formed on the outside of the can is accumulated in the coaster, the condensation will flow out of the coaster when it is tilted while drinking from the can thereby causing the user's hands, clothes, and surroundings to become wet.

The present invention is directed to a combination can cap and coaster in which the coaster includes grooves which are sized, shaped, and limited in number to allow condensation from the outside of the can to flow into a reservoir in the coaster, but limits and restricts the flow of liquid therefrom.

SUMMARY

The present invention provides a combination can cap and coaster for a drink can which has a top which has an annular lip thereon whereby the device of the present invention may be secured with the lip on the can to seal off the can after it is opened. Also, the device of the present invention can be used as a coaster for receiving a can therein, the device having a peripheral rim which includes grooves to drain condensation from the outside of the can into the coaster whereby the condensation may be collected. However, the coaster limits the flow of condensation out of the coaster. The cross-sectional area of the grooves are restricted to limit flow of liquid therethrough and while sufficient to allow the accumulation of condensation into the coaster over an extended period of time, restricts the flow out of the coaster during the shorter time periods of drinking. Preferably, the size of the grooves is approximately 0.025 by 0.025 inches.

Yet a still further object of the present invention is wherein the grooves terminate adjacent but spaced from the support surface of the coaster. Preferably, the length of the grooves is greater than the distance between the grooves and the coaster support surface thereby allowing the weight of water to assist in forcing the can moisture into the coaster.

Still a further object of the present invention is wherein the number of grooves is no greater than eight, and is preferably approximately five, for restricting the flow of fluid out of the coaster.

Yet still a further object of the present invention is wherein the can cap and the coaster have an upper edge which is directed downwardly and inwardly to capture moisture on the outside of the can and direct the moisture into the coaster.

Other objects and advantages of the present invention will become apparent from the consideration of the following description and drawings.

BRIEF DESCRIPTION OF THE DRAWINGS

FIG. 1 is a perspective view illustrating the preferred embodiment of the combination can cap and coaster of the present invention;

FIG. 2 is a top view illustrating the present invention;

FIG. 3 is as sectional line on the line 3—3 of FIG. 2 illustrating further structural details of the combination can cap and coaster of the present invention;

FIG. 4 is a side elevational view of a can positioned in the device, shown in sectional view, when it is employed as a coaster; and FIG. 5 is a side elevational view illustrating the device of the present invention in sectional view engaged with the top of a can for closing off the can after it has been opened.

DESCRIPTION OF THE PREFERRED EMBODIMENT

It can be appreciated that the present invention may be used with a can or other vessel as a coaster even though the can may not be suited for use with the present invention for closing off the can.

In FIG. 1, the invention is referred to generally by the numeral 10 and is shown as comprising a member referred to generally by the numeral 12. The member 12 has an upper edge 13 and a lower edge 14 formed on a peripheral rim 15. The peripheral rim 15 is provided with an inner surface 16 which is connected to and surrounds a base or support surface 17. The rim 15 and base 17 define a recess 18 in the device 12 that provides a coaster for receiving a can C as illustrated in FIG. 4 of the drawings.

The outer surface 20 of the rim 15 is interrupted preferably in the form of grooves or recesses 22 therein to form or provide a gripping surface for manually holding the combination can cap and coaster 10 when it receives a can C as illustrated in FIG. 4 of the drawings. The inner surface 16 of rim 15 is provided with recesses or grooves 23 for receiving condensation that is formed on the outer surface of the can and directing or conducting the condensation to the base or support surface 17 to prevent such condensation from flowing onto the surface of the table or the like where the coaster with the can therein can be placed during use.

However, it is important that the condensation, while flowing onto the support surface 17, be restricted and limited in flowing back out of the recesses or grooves 23 when the can C and member 12 are tilted for taking a drink out of the can C. The member 12 is a resilient plastic member, such as PVC. The peripheral rim 15 has an inner circular surface 16 extending upwardly from the support surface 17 and is sized to grippingly receive the exterior of a can C to provide a sealing surface therebetween except for the grooves 23. The cross-sectional area of the grooves 23 is restricted to limit the flow of liquid therethrough. Thus, the grooves 23 will accumulate liquid over a period of time, and will allow it to flow onto the support surface 17 over an extended period of time. However, the restriction of the grooves 23 will limit the passage of any fluid accumulated into the bottom of the coaster from flowing back out of the grooves 23 when the coaster 10 and cap C are tilted by an individual taking a drink therefrom. In the preferred embodiment, the grooves 23 are longitudinal slots having a size of 0.025 by 0.025 inches. While, of course, larger size slots would allow the accumulation of moisture from the can faster, they would also allow the accumulated moisture to flow out of the coaster when tilted.

In addition, the number of grooves 23 is limited. The number of grooves 23 should be no greater than eight and in the preferred embodiment are preferably five. This limitation on the number of grooves 23 also restricts the amount of trapped condensation that could come back out of the coaster under normal sipping of beverages from the can C. Additionally, with only five grooves 23, the grooves 23 would be spaced approximately 72° apart. Therefore, when the can C is randomly placed into the coaster 10, if the drinking spout on the can C is out of line with one of the grooves 23, then again the tendency of trapped condensation to leave the bottom of the coaster is restricted.

Referring again to the drawings, it is to be noted that the lower ends 19 of the grooves 23 terminate adjacent to but spaced from the support surface 17. It is also to be noted in FIG. 4 that the bottom surfaces of the can C are rounded, thereby leaving a cavity or chamber 20 circumferentially around the bottom of the can C. The bottom end of the recesses 23 are in communication with the cavity or chamber 20 to allow it to accumulate the condensation therein. However, the height of the grooves 23 is greater than the space between the lower ends 19 of the grooves 23 and the support surface 17. Therefore, when condensation accumulates in the grooves 23, the height of the condensation therein will tend to exert a force causing the condensation to move downwardly into the chamber 20. However, when the can is tilted, the height or depth of the liquid in the chamber 20 is less (the distance between ends 19 and support 17) and therefore it has less of a tendency to flow back out of the restricted grooves 23.

Referring to FIG. 3, it is to be noted that the upper edge 13 of the member 12 is preferably directed downwardly such as by a taper 21 or rounded whereby the downwardly directed portion 21 tends to accumulate condensation from around the outside of the can C and directed to the top of the grooves 23.

An annular bottom edge surface 25 is formed on the device 12 and terminates in the opening 26 which opening is spaced upwardly from the annular bottom surface 25 as shown and is joined therewith by the annular inwardly tapered surface 27 as shown.

An annular recess 28 is formed immediately adjacent the bottom of the support or base 17 as shown, such recess being of larger diameter than the adjacent opening 26 to receive the can lip 32 and seal off the top of the can. The recess 28 provides a surface 31 for engaging and sealing with the top T of the lip 32 on can C; an annular surface **31*a* for engaging the annular edge 32*a* of the lip 32; and a surface 31*b* for engaging the bottom surface 32*b* of the lip 32. The opening 26 provides an annular surface 26*a* for engaging the annular surface 33 on can C immediately below lip 32. This relationship is illustrated in FIG. 5 and it will be noted that the tapered surface 27 abuts a tapered surface 27' on the can C while the annular recess 28 engages the top rim or edge of the can as described above. The surface 26*a* engages the circular portion 33 of the can C immediately adjacent and below the lip 32** on the can to further assist in closing thereof.

The advantages of the present invention are that it can be uniformly employed with cans that are universally used in the distribution and consumption of beverages and serves both to support the can during use as well as forming a positive seal or closure for the can to retain the contents in a desired condition when not in use, such closure being effective over an extended period of time.

Preferably the measurements of device 12 are approximately as follows: upper edge 13 to support 17 is 0.56 inches; the thickness of the base or support surface 17 is 0.08 inches; the width of recess 28 is 0.11 inches; the width of annular surface **26*a* formed on opening 26 is 0.05 inches; the distance from the lower annular edge of opening 26 to the bottom surface 25 is 0.075 inches; the lateral extent from the inner end of bottom surface 25 to the edge of surface 26*a* on opening is 0.04 inches; the angle on surface 27 is 45°; the width of bottom surface 25 is 0.18 inches; the width of rim 15 between the upper edge 18 and support surface 17 is 0.08 inches; the inner diameter of the recess 18 from upper edge 13 of rim 15 to the surface 17 and upper edge is 2.54 inches; the diameter of opening 26 is 2.26 inches; the diameter from the inner edge of bottom surface 25 is 2.34 inches; the outer diameter of the device 12 is 2.70 inches; the length of the groove 23 is 0.4 inches; and the ends 19 are spaced 0.16 inches from the surface 17**.

The foregoing disclosure and description of the invention are illustrative and explanatory thereof, and various changes in size, shape and materials as well as in the details of the illustrated construction may be made without departing from the spirit of the invention.

What is claimed is:

1. A cap and coaster for use on a circular can having a lip at its upper end comprising:

a resilient plastic member having upper and lower edges;

a support surface;

a peripheral rim extending above, below and connected to said support surface;

said peripheral rim having an inner cylindrical surface extending from said support surface to said upper edge of said member and sized to provide a coaster for gripping, receiving and supporting a can;

said peripheral rim having an outer surface extending between said upper edge and lower edge of said member;

a plurality of circumferentially spaced grooves in said inner cylindrical surface terminating adjacent said support surface, the cross-sectional area of said grooves being restricted to limit the flow of liquid therefrom;

an annular bottom surface adjoining said lower edge;

an opening in said bottom surface;

an annular recess adjacent said opening, said recess having a larger diameter than the diameter of said annular opening to provide a configuration between said opening and said recess that conforms with the configuration of a lip on a can for sealingly engaging a can lip to seal off the contents of a can.

2. The can cap and coaster of claim 1 wherein the grooves terminate adjacent but spaced from the support surface.

3. The can cap and coaster of claim 2 wherein the length of the grooves is greater than the distance between the grooves and the support surface.

4. The can cap and coaster of claim 1 wherein the number of grooves is no greater than eight.

5. The can cap and coaster of claim 4 wherein the number of grooves is approximately five.

6. The can cap and coaster of claim 1 wherein the size of the grooves is approximately 0.025 by 0.025 inches.

7. The can cap and coaster of claim 1 wherein the upper edge is directed downwardly and inwardly to capture moisture on the outside of the can.

8. The can cap and coaster of claim 3 wherein the number of grooves is approximately five and the size of the grooves is approximately 0.025 by 0.025 inches.

* * * * *